US007082861B1

(12) United States Patent
Chen

(10) Patent No.: US 7,082,861 B1
(45) Date of Patent: Aug. 1, 2006

(54) RATCHET WRENCH

(76) Inventor: Yu Tang Chen, No. 22, Lane 427, Dasheng Street, Taichung City 408 (TW)

( * ) Notice: Subject to any disclaimer, the term of this patent is extended or adjusted under 35 U.S.C. 154(b) by 0 days.

(21) Appl. No.: 11/267,727

(22) Filed: Nov. 7, 2005

(51) Int. Cl.
*B25B 13/46* (2006.01)

(52) U.S. Cl. ..... 81/63.2; 81/63

(58) Field of Classification Search ..... 81/60, 81/61, 62, 63, 63.1, 63.2
See application file for complete search history.

(56) References Cited

U.S. PATENT DOCUMENTS 5,857,390 A * 1/1999 Whiteford ..... 81/62
6,044,731 A * 4/2000 Hsieh ..... 81/63.2
6,408,722 B1 * 6/2002 Chen ..... 81/60
6,868,759 B1 * 3/2005 Tuan-Mu ..... 81/63.2

* cited by examiner

*Primary Examiner*—Jacob K. Ackun Jr.

(57) ABSTRACT

A ratchet wrench comprises a main body having a hole at an action end; a ratchet having a polygonal groove at its center and a latch hole and a latch groove interconnected to the polygonal groove. The latch hole is disposed at the edge of the polygonal groove, and the latch groove is disposed at the corner of the polygonal groove, and the whole is accommodated in the hole of the main body. A latch ring is installed at the external side of the ratchet with its end bent into a latch end and passed into the latch hole of the ratchet, and the other end is bent into a latch surface to be latched into the latch groove, such that the latch end and the latch surface are slightly protruded from the polygonal groove. If the polygonal groove of the ratchet is sheathed onto an object, two different latch structures are defined between the latch ring and the object.

13 Claims, 15 Drawing Sheets

RATCHET WRENCH

BACKGROUND OF THE INVENTION

1. Field of the Invention

The present invention relates to a wrench, and more particularly to a ratchet wrench structure for securing screw devices.

2. Description of the Related Art

A prior art structure as shown in FIG. 12 comprises:

a main body 91, having a hole 911 disposed at an action end and a groove 912 disposed on one side;

a ratchet 92, contained in the hole 911 and having an engaging tooth 922 and a polygonal groove 921 at the center, and the ratchet 92 and the polygonal groove 21 is cut into two latch grooves 923, and the latch grooves 923 are disposed at the corners of the polygonal groove 921 and parallel to the edges of the polygonal groove 921, and the ratchet 92 includes a turntable 924;

a brake tooth 93, having an engaging tooth 922 disposed on one side and engaged with a latch tooth 931 and contained in the groove 912 of the main body 91;

a latch ring 94, having a latch surface 941 latched into the latch groove 923, and two latch surfaces 941 are extended into the polygonal groove 921 of the ratchet 20, and its assembly is shown in FIG. 13 and its cross sectional view is shown in FIG. 14.

The shortcomings of the prior art structure include:

1. Two latch surfaces 941 of the latch rings 94 are latched to two corners of a screwdriver head 80 by a linear contact as shown in FIG. 15, and thus the connection is not secure.

2. The latch ring 94 in an n-shape is latched into the latch groove 923 as shown in FIG. 12, and thus the latch ring 94 will be separated from the latch groove 923 easily.

SUMMARY OF THE INVENTION

Therefore, it is a primary objective of the present invention to provide a ratchet wrench that comprises a main body having a hole at an action end; a ratchet having a polygonal groove at its center and a latch hole and a latch groove interconnected to the polygonal groove, and the latch hole is disposed at the edge of the polygonal groove, and the latch groove is disposed at the corner of the polygonal groove, and the whole is accommodated in the hole of the main body. A latch ring is installed at the external side of the ratchet with its end bent into a latch end and passed into the latch hole of the ratchet, and the other end is bent into a latch surface to be latched into the latch groove, such that the latch end and the latch surface are slightly protruded from the polygonal groove. If the polygonal groove of the ratchet is sheathed onto an object, two different latch structures are defined between the latch ring and the object.

DESCRIPTION OF THE PREFERRED EMBODIMENTS

Figure 1:
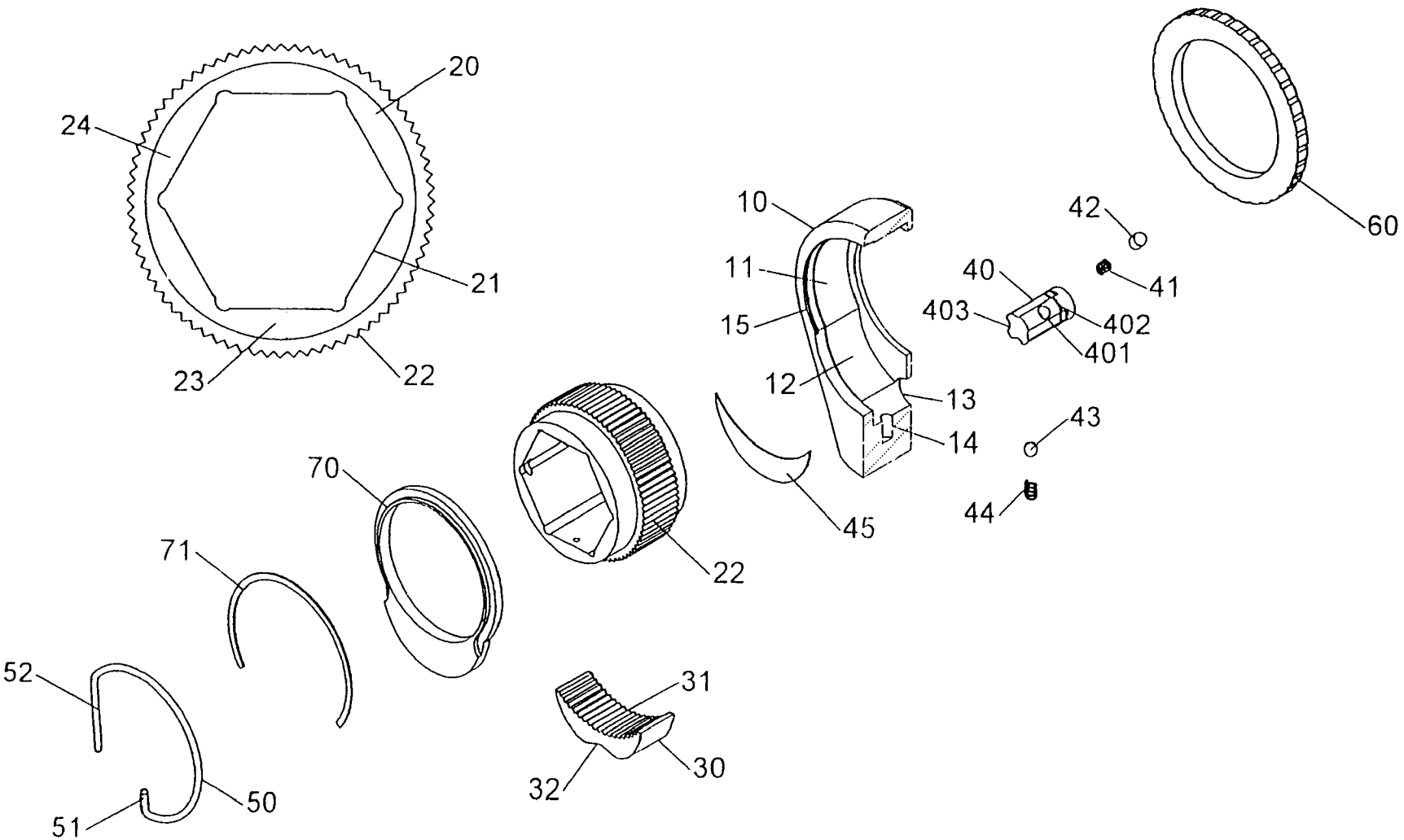
FIG. 1 is an exploded view of the invention.
Figure 2:
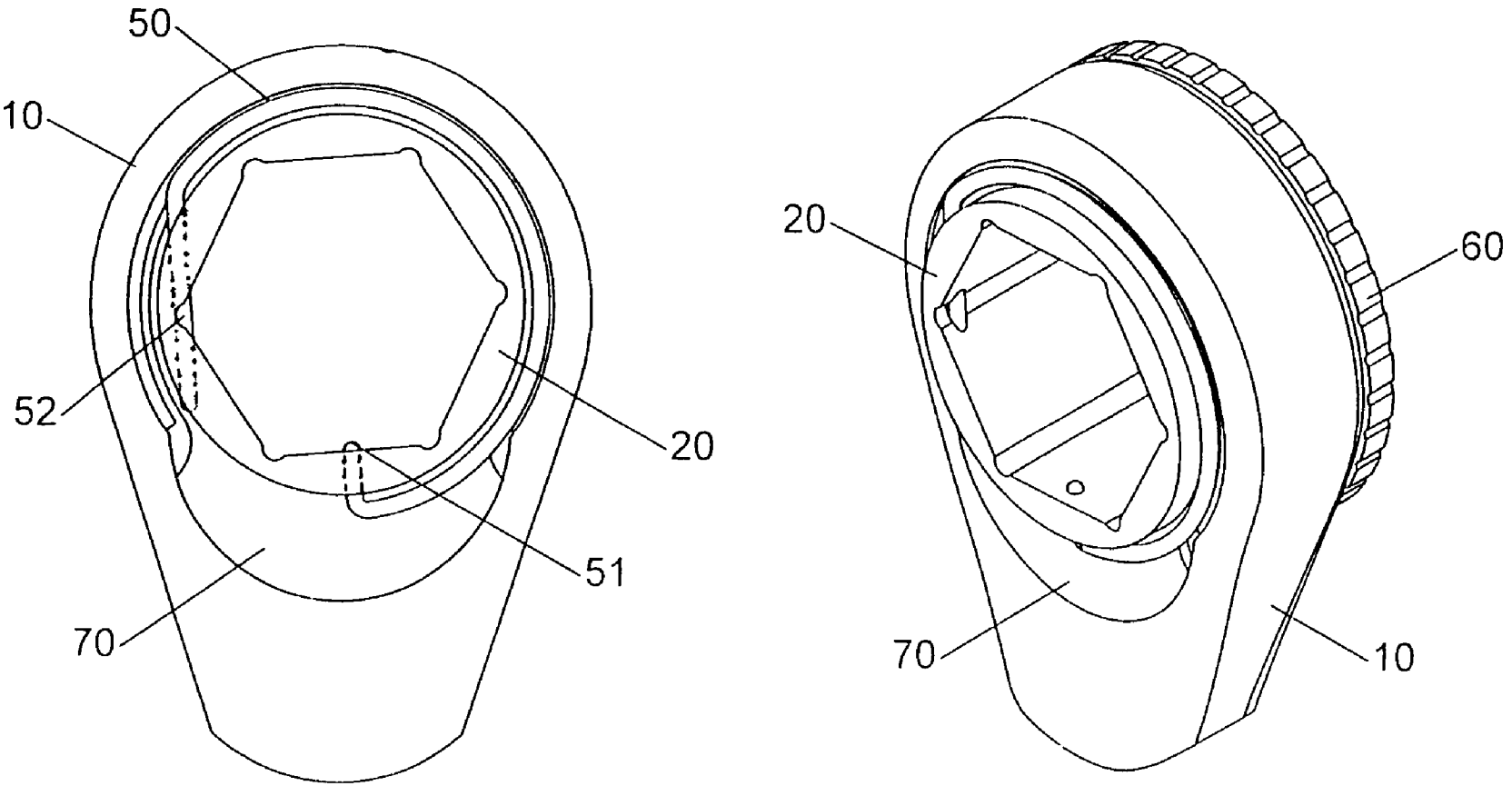
FIG. 2 is a perspective view of the invention.
Figure 3:
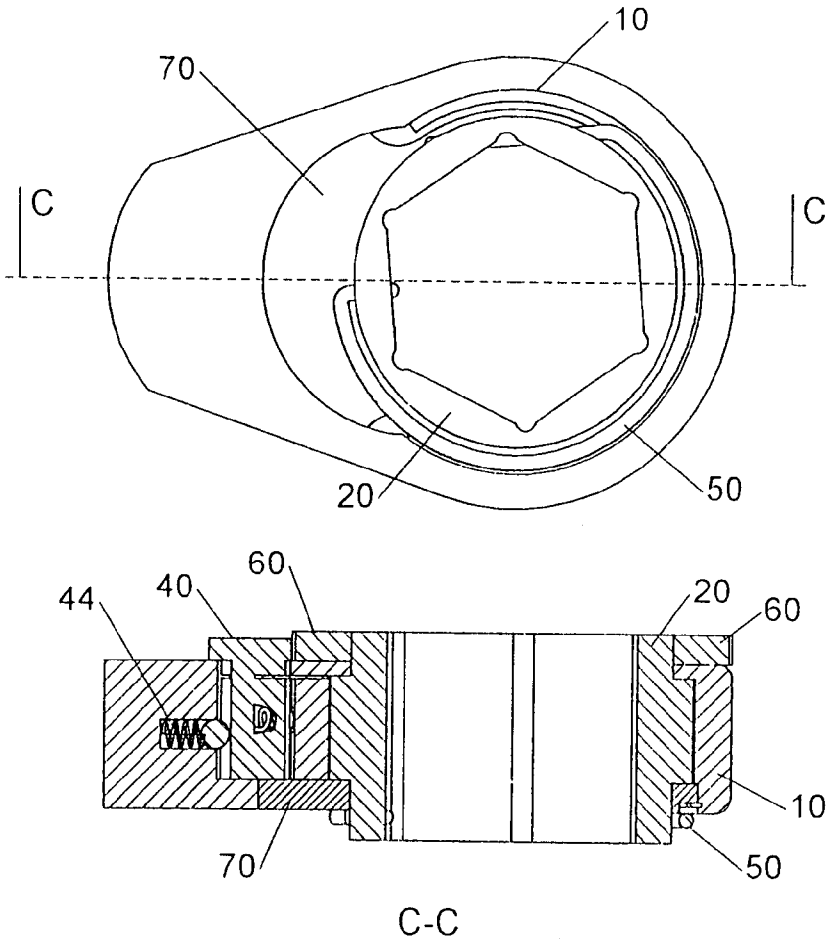
FIG. 3 is a cross-sectional view of the invention.

Referring to FIG. 1, the present invention comprises:

a main body 10, having a hole 11 disposed at an action end, a groove 12 disposed at a side of the hole 11, a buckle groove 15 disposed at the hole 11, a control groove 13 disposed at a handle section proximate to the groove 12, and a bead groove 14 disposed along the radial direction, and the groove 12 and a control groove 13 are interconnected with the bead groove 14;

a ratchet 20, having an engaging tooth 22 disposed around the ratchet 20, a polygonal groove 21 disposed at the center, a latch hole 23 and a latch groove 24 disposed on the ratchet 20 and interconnected with the polygonal groove 21, and the latch hole 23 is situated at an edge of the polygonal groove 21, and a latch groove 24 s situated at a corner of the polygonal groove 21 and parallel with the latch hole 23, and the whole is contained in the hole 11 of the main body 10;

a brake tooth 30, having a semicircular shape and a latch tooth 31 disposed on one side of the ratchet 20 and engaged with the engaging tooth 22, and the brake tooth 30 forms a concave surface 32 at its rear side, and the whole is contained in the groove 12 of the main body 10, and the brake tooth 30 can be rotated clockwise or counterclockwise in the groove 12 of the main body due to the left or right shift of the control structure;

a control structure, having a containing hole 401 disposed at the front side of the control component 40 for containing a press nut 42 and an elastic component 41, and the press nut 42 presses against the concave surface 32 of the brake tooth 30, so that the brake tooth 30 is engaged with the ratchet 20, and the control component 40 is pivotally coupled into the control groove 13 of the main body 10, and the control component 40 includes a press surface 402 at the top for latching a press plate 45, and the press plate 45 is contained in the groove 12 of the main body 10, and the control component 40 may fall out from the control groove 13 easily due to the restriction of the press plate 45, and the control component 40 forms a concave edge 403 for pressing against the bead 43 and the elastic member 44, and the bead 43 and the elastic member 44 are contained in the bead groove 14 of the main body 10, and the bead 43 is used for positioning when the control component 40 is rotated in the control groove 13;

a latch ring 50, surrounding the external periphery of the ratchet 20 with a range larger than 180 degrees, and an end of the latch ring 50 bent into a latch end 51 can be passed into the latch hole 23 of the ratchet 20 and the other end bent into a latch surface 52 can be latched into the latch groove 24;

a turntable 60, disposed on the ratchet 20 and having an external diameter larger than the internal diameter of the hole 11; and a chassis 70, being latched onto the buckle groove 15 of the main body 10 by a buckle 71 and sealing all components in the main body 10, and the latch ring 50 is exposed from the chassis 70. After the chassis 70 is assembled as shown in FIG. 2, the latch end 51 of the latch ring 50 is latched into the latch hole 23 of the ratchet 20, and the latch surface 52 can be latched onto the latch groove 24, and the latch end 51 and the latch surface 52 are protruded slightly from the polygonal groove 21. FIG. 3 shows its cross-sectional view.

Figure 4:
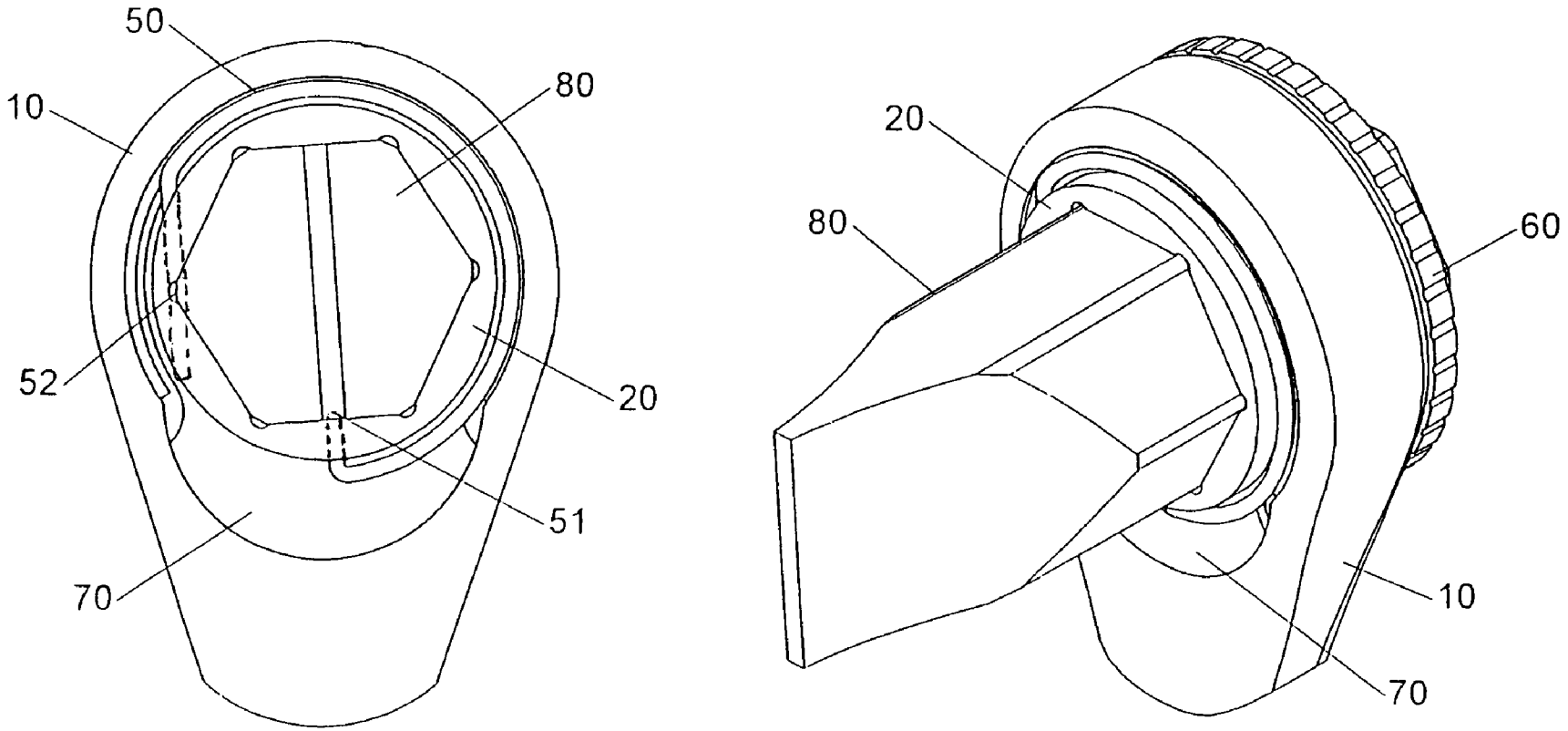
FIG. 4 is a schematic view of securing screwdriver head of the invention.

In FIG. 4, if the polygonal groove 21 of the ratchet 20 is connected to a screwdriver head, the latch end 51 of the ratchet 20 is latched to an edge of the screwdriver head 80 in a point contact, and the latch surface 52 is latched to a corner of the screwdriver head 80 in a linear contact, so that the screwdriver head 80 will not fall out from the ratchet 20. If the screwdriver head 80 is latched, the point contact of the latch end 51 and the linear contact of the latch surface 52 provide two different latch structures between the latch ring 50 and the screwdriver head 80, which is considered the major advantage of this invention.

Figure 5:
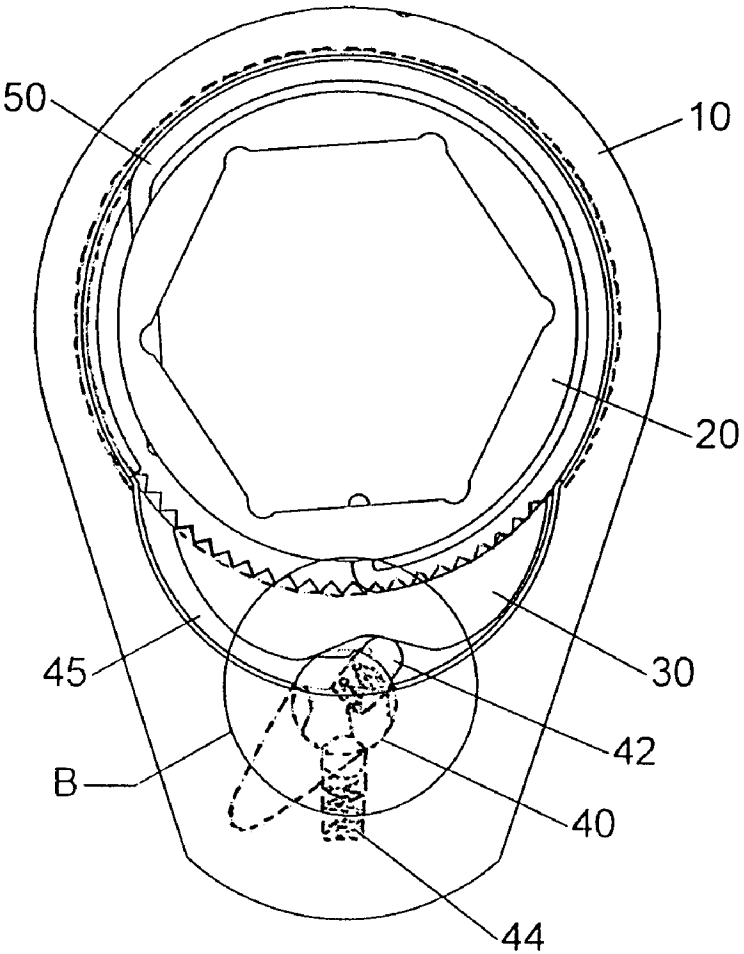
FIG. 5 is a schematic view of an operation of the invention.
Figure 5:
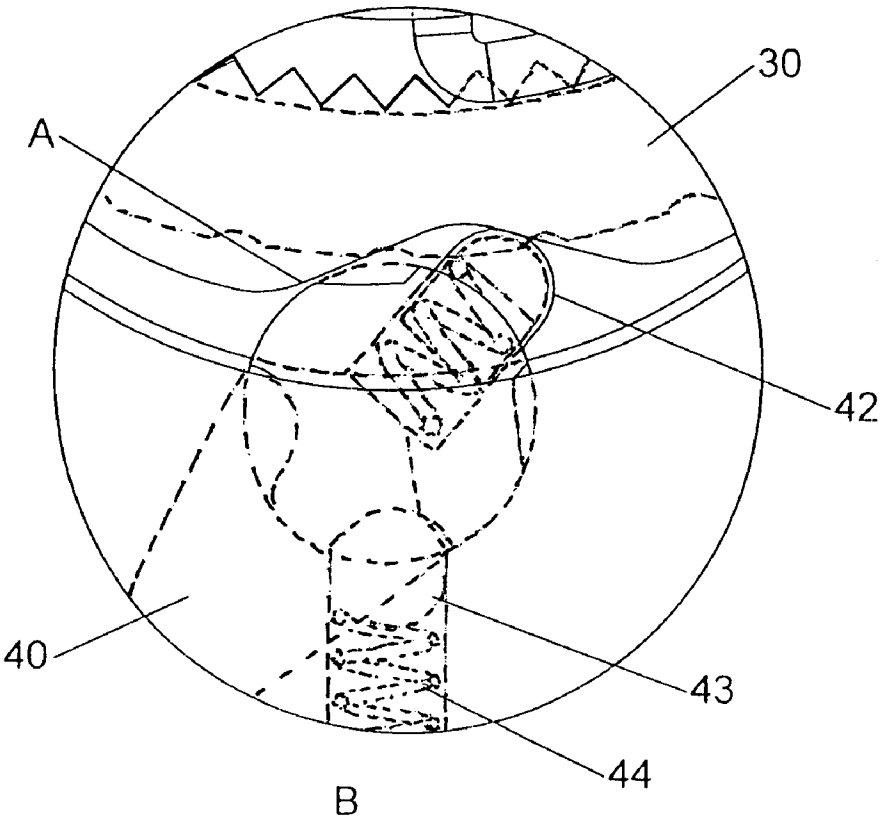

Referring to FIG. 5 for the principle of operating the control structure of the present invention, the containing hole 401 of the control component 40 contains the press nut 42, and the brake tooth 30 presses against the edge of the groove 12 of the main body 10, and the circumferential surface of the control component 40 props the concave surface 32 of the brake tooth 30 as indicated by A without pressing against the lateral surface of the brake tooth 30 of the groove 12, and the concave surface 32 at the bottom of the brake tooth 30 can be propped by the control component 40. During the rotation of the ratchet wrench, the brake tooth 30 and the ratchet 20 can be engaged better. In such design, the external periphery of the control component 40 is a cylinder, and the concave surface 32 of the brake tooth 30 and the external periphery of the control component 40 are cut, so that the contact surface of the two is a straight line. When the control component 40 props, the brake tooth 30 has an effect of being withdrawn.

Figure 6:
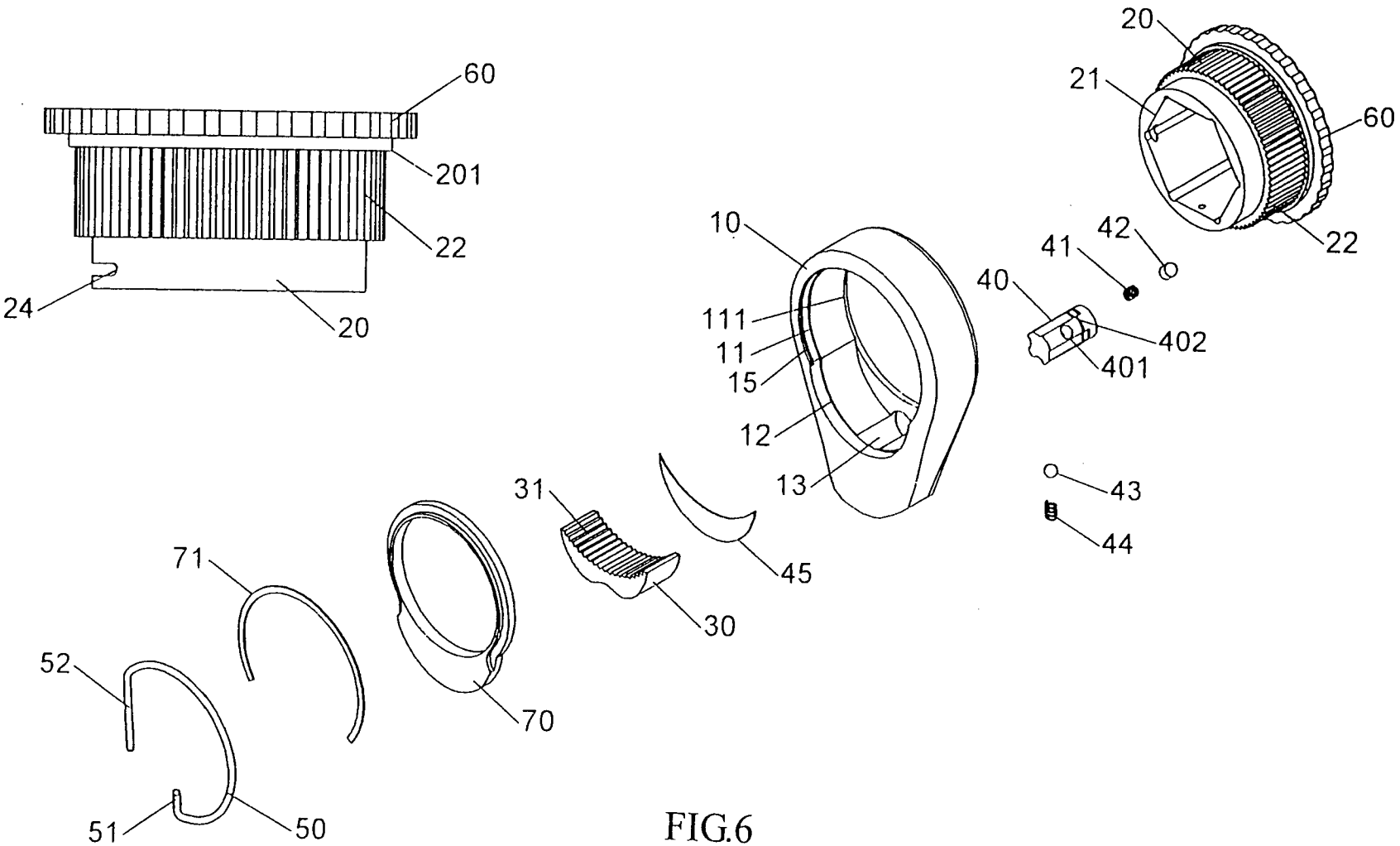
FIG. 6 is an exploded view of a second preferred embodiment of the invention.
Figure 7:
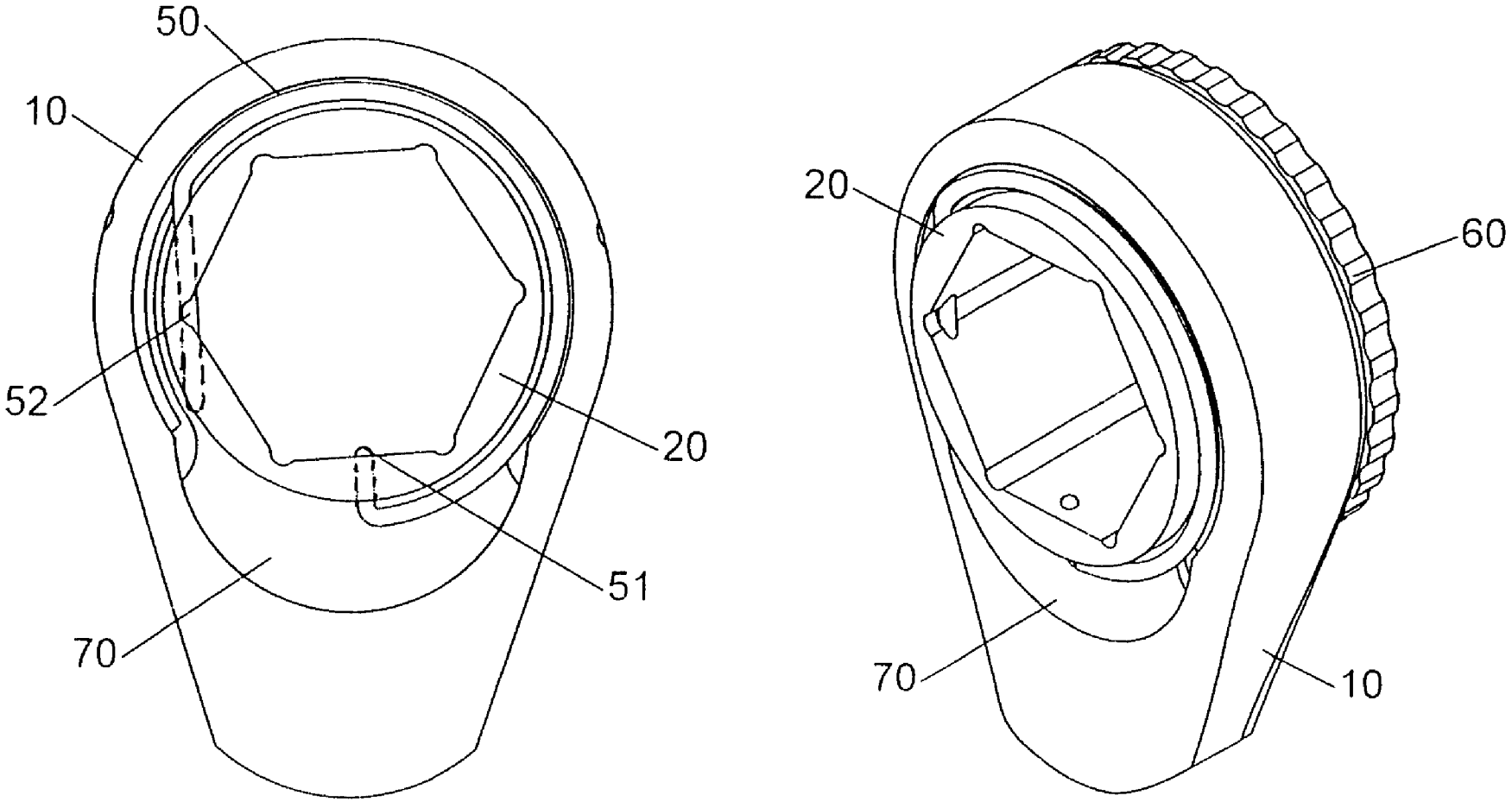
FIG. 7 is a perspective view of a second preferred embodiment of the invention.
Figure 8:
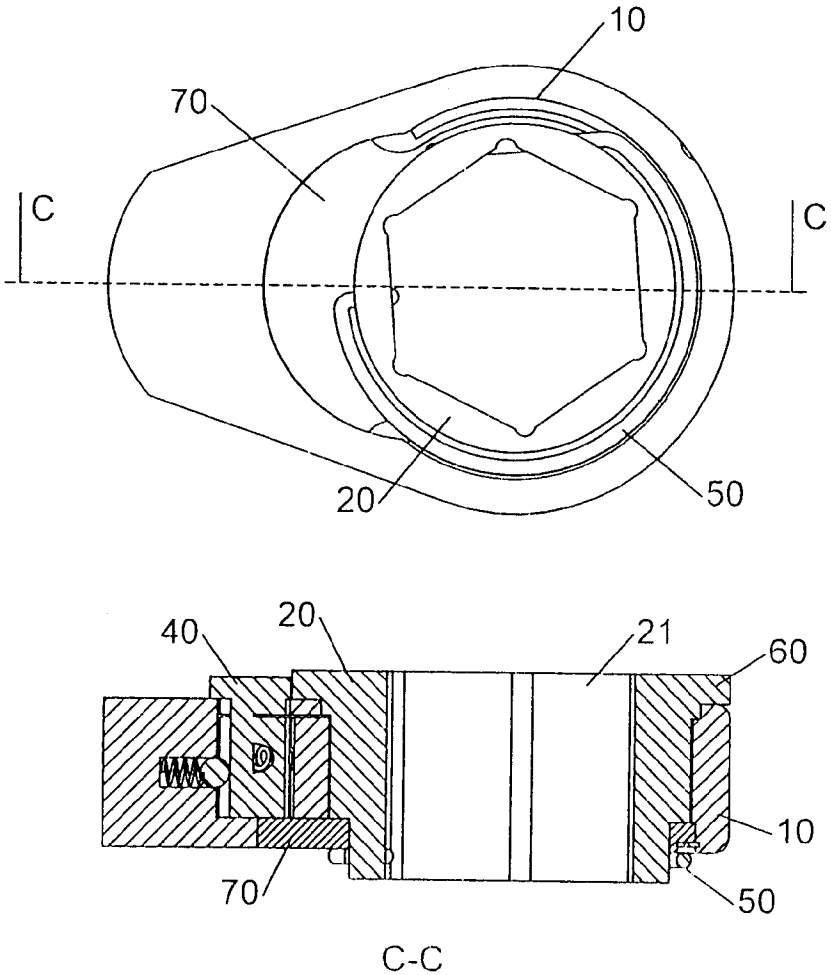
FIG. 8 is a cross-sectional view of a second preferred embodiment of the invention.

FIG. 6 shows a second preferred embodiment, and the turntable 60 is fixed directly onto the ratchet 20, so that the two are integrated as a whole. FIGS. 7 and 8 are cross-sectional views of the assembly.

Figure 9:
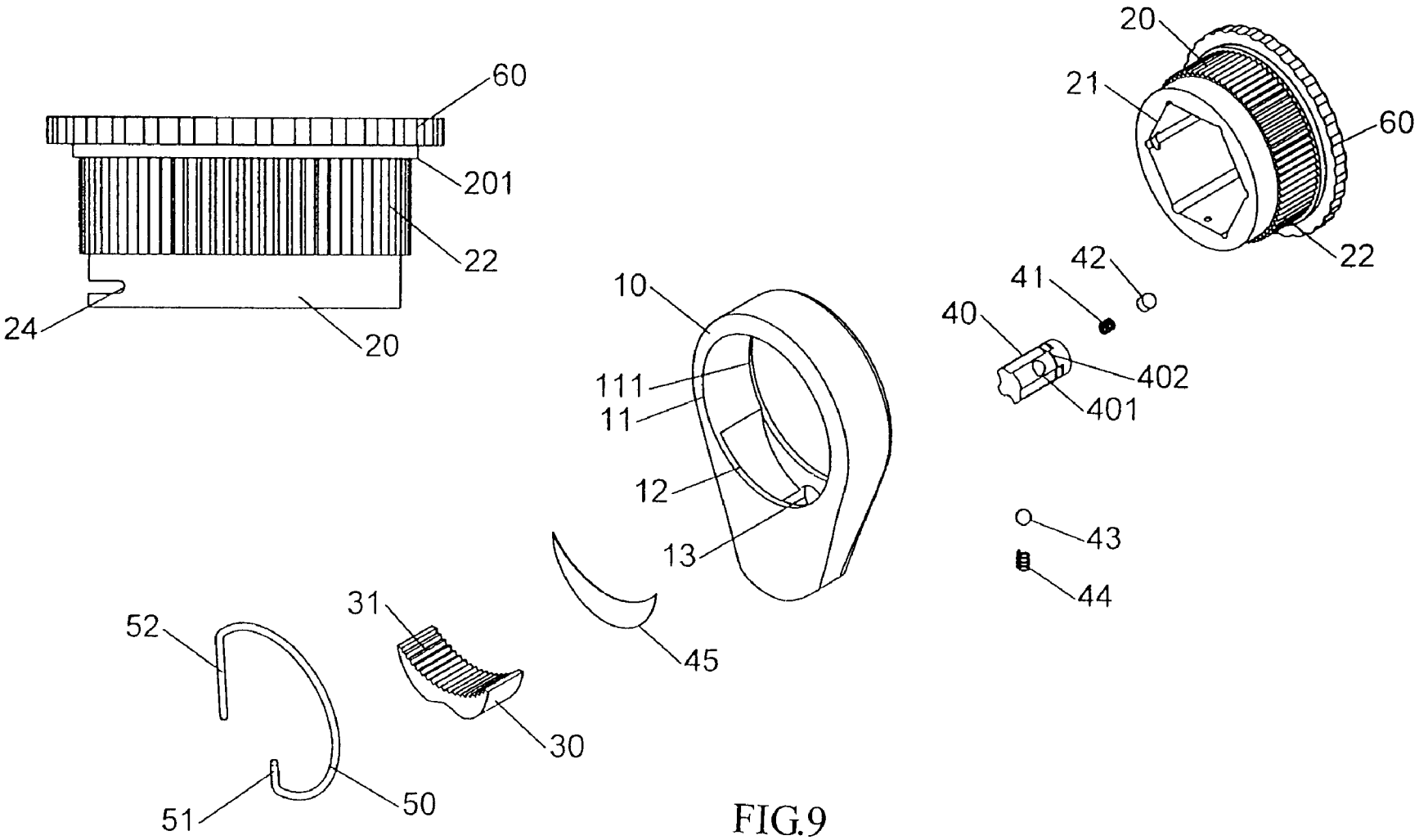
FIG. 9 is an exploded view of a third preferred embodiment of the invention.

FIG. 9 shows a third preferred embodiment that omits the buckle groove 15, chassis 70, and buckle 71 of the first preferred embodiment. The hole 11 of the main body 10 has a diameter larger than the containing groove 111 of the hole 11. The top and bottom of the groove 12 of the main body 10 are sealed, and the turntable 60 and ratchet 20 are connected integrally, and the ratchet 20 includes a containing section 201 having the same diameter as the containing groove 111 of the main body 10.

Figure 10:
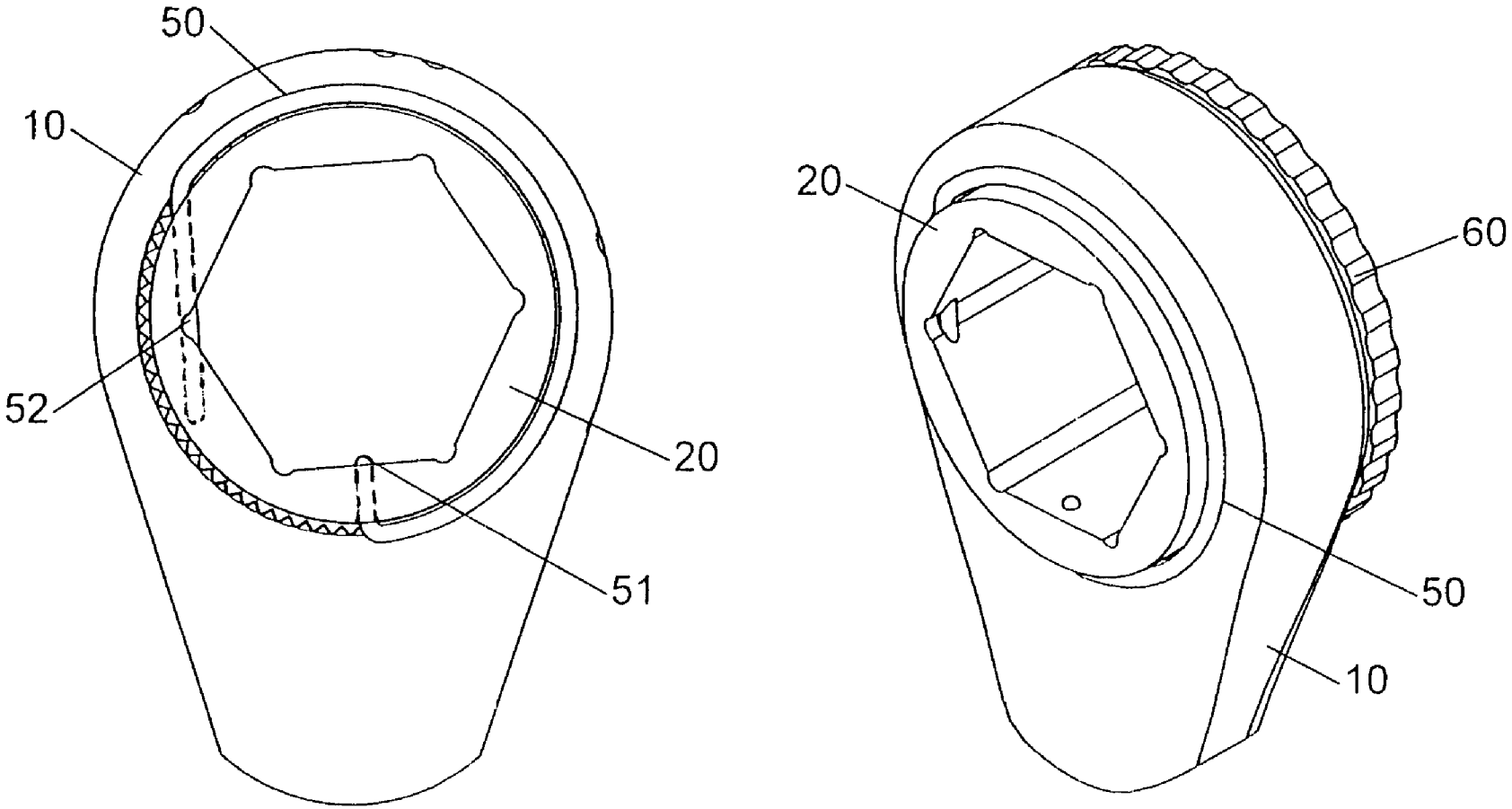
FIG. 10 is a perspective view of a third preferred embodiment of the invention.
Figure 11:
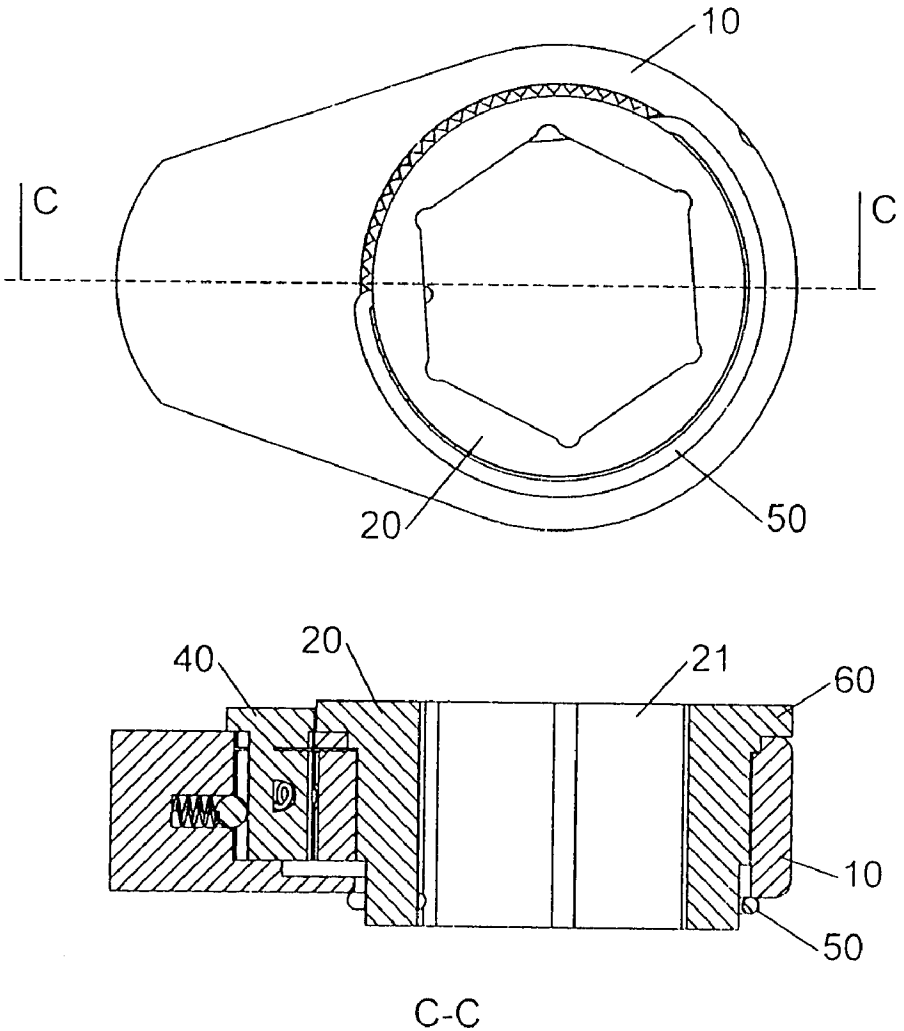
FIG. 11 is a cross-sectional view of a third preferred embodiment of the invention.
Figure 12:
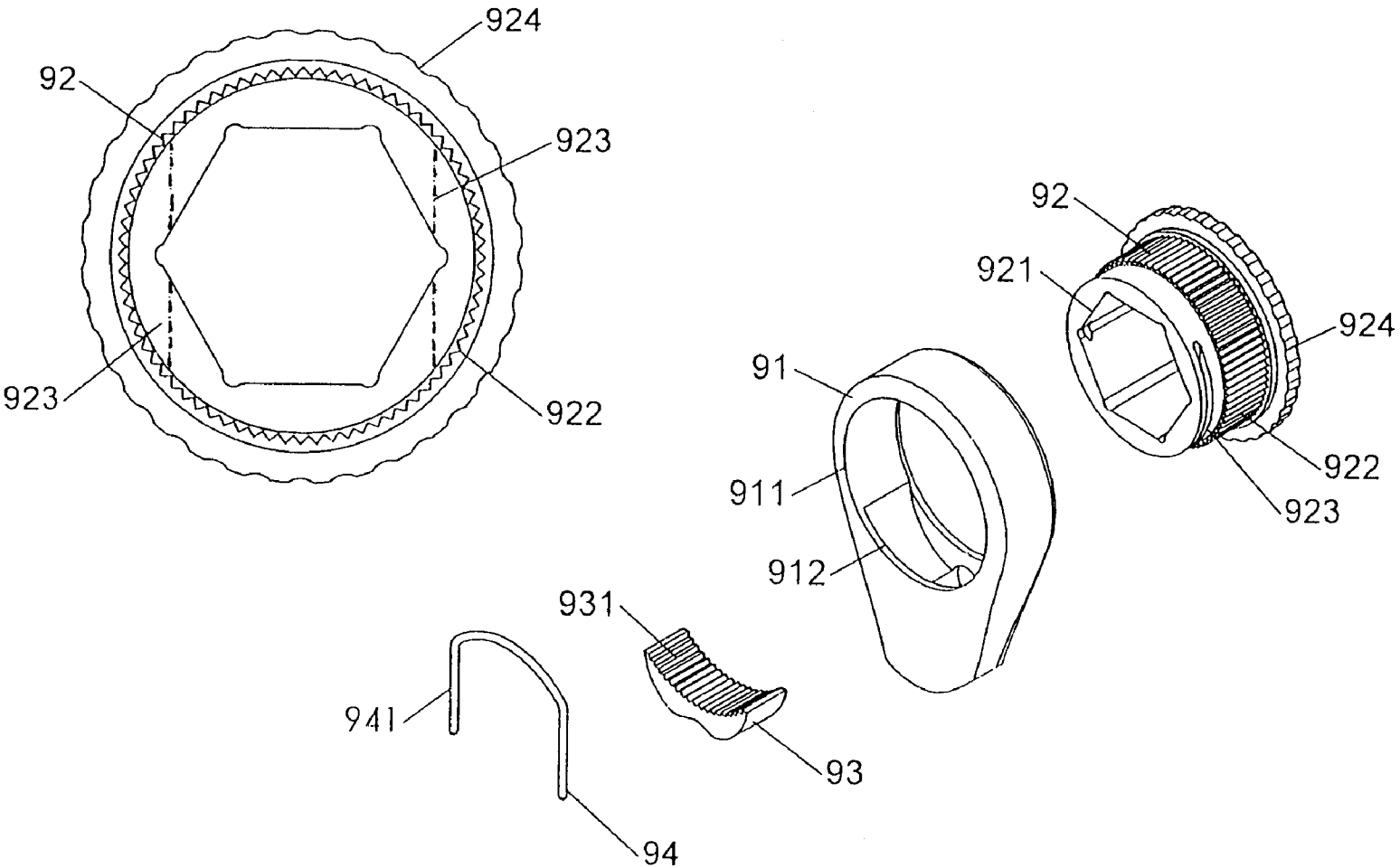
FIG.12 PRIOR ART
FIG. 12 is an exploded view of a prior art ratchet wrench.
Figure 13:
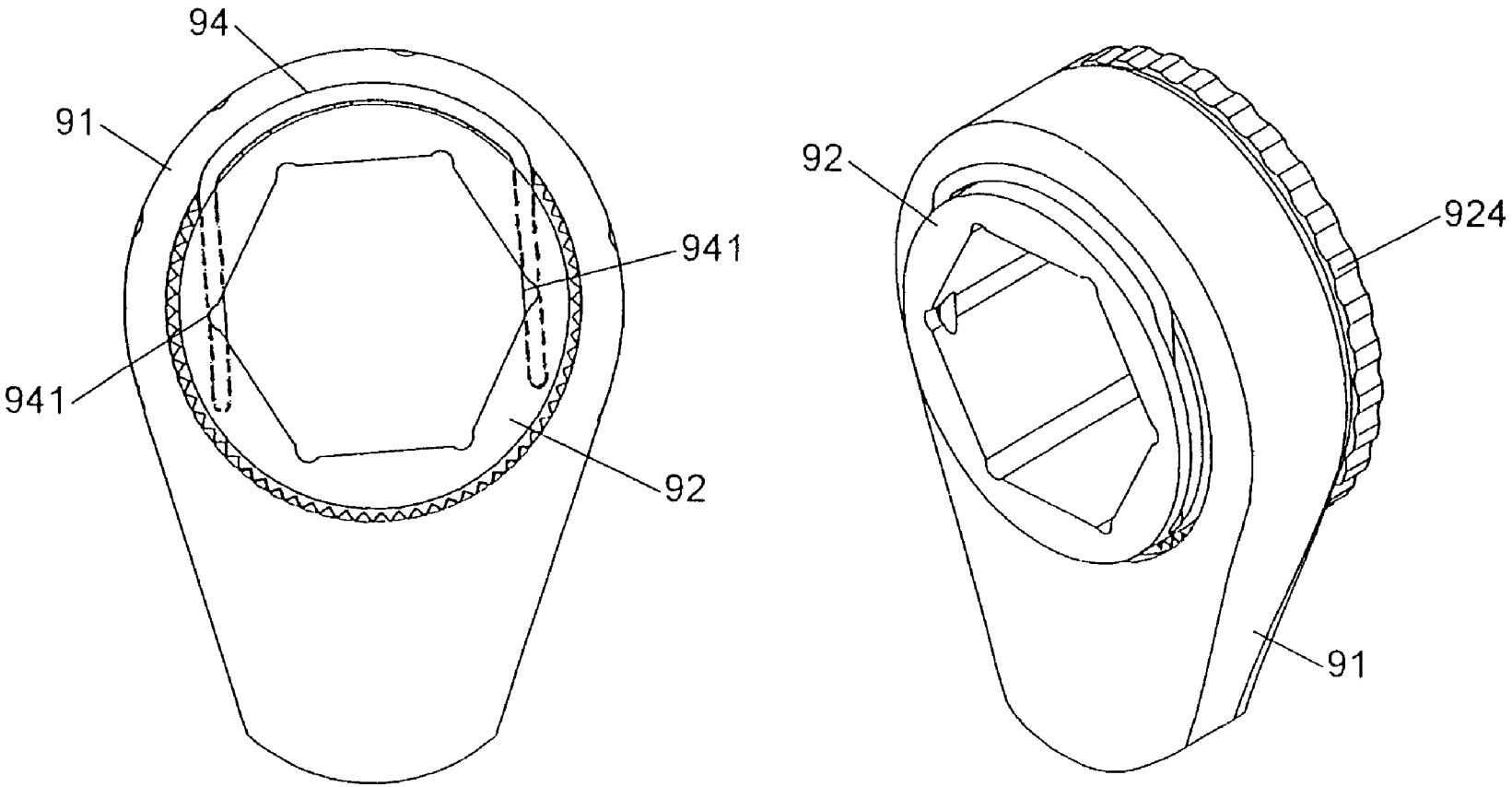
FIG.13 PRIOR ART
FIG. 13 is a perspective view of a prior art ratchet wrench.
Figure 14:
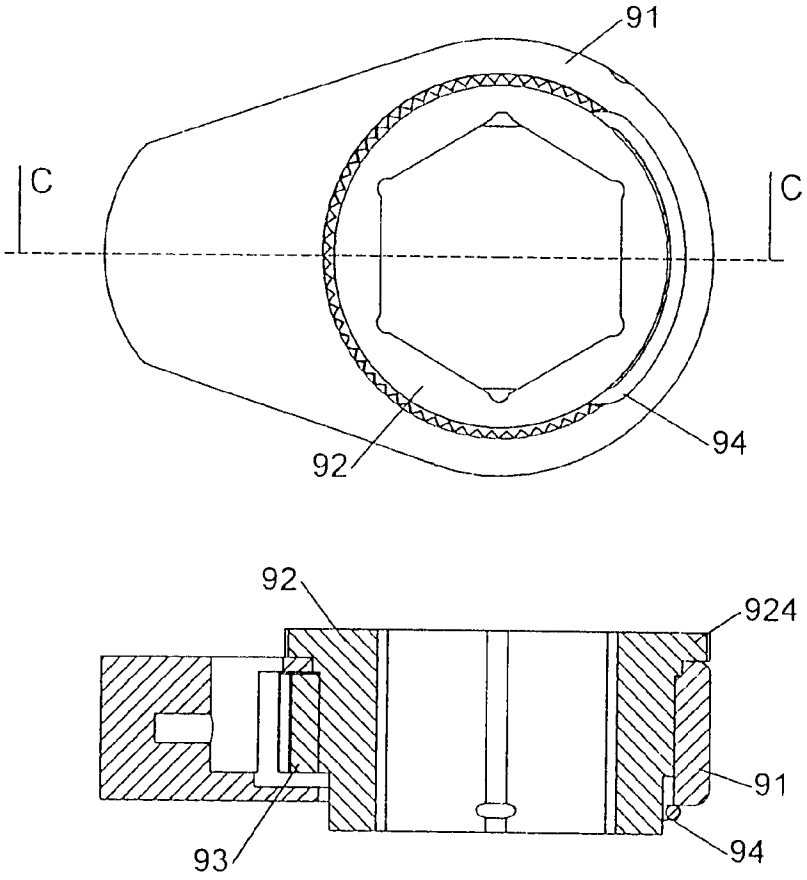
FIG.14 PRIOR ART
FIG. 14 is a cross-sectional view of a prior art ratchet wrench.
Figure 15:
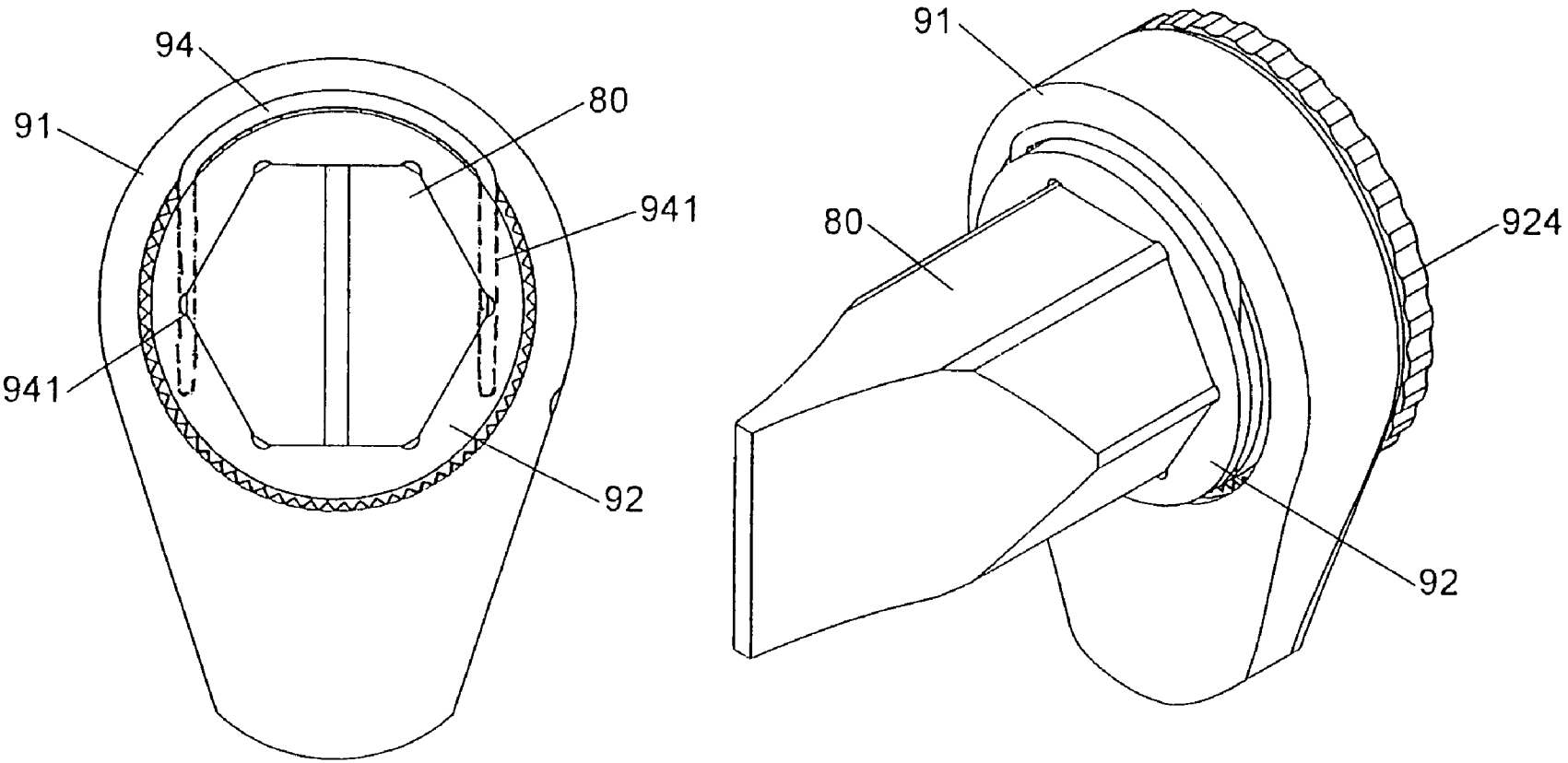
FIG.15 PRIOR ART
FIG. 15 is a schematic view of securing a prior art screwdriver head.

In the assembly as shown in FIG. 10, the ratchet 20 is contained in the hole 11 of the main body 10, and then the containing section 201 of the ratchet 20 is contained in the containing groove 111 of the main body 10, and the latch ring 50 surrounds the ratchet 20 over 180 degrees, and the external diameter of the latch ring 50 is larger than the internal diameter of the hole 11 of the main body 10, and the ratchet 20 is restricted by the latch ring 50 and will not fall out from the hole 11. FIG. 11 shows the cross-sectional view of the upper and lower ends of the ratchet 20 being restricted at the turntable 60 and the latch ring 50 and contained into the hole 11.

The advantages of the present invention include:

1. During the latch of the ratchet wrench, the point contact of the latch end and the linear contact of the latch surface 52 provide two different latch structures between the latch ring 50 and the screwdriver head 80.
2. The latch ring 50 will not fall out from the ratchet 20 due to the latch end 51 and the latch surface 52.
3. The latch ring 50 is bent at two positions, and thus the manufacturing cost of the latch ring 50 can be lowered.

What is claimed is:

1. A ratchet wrench, comprising:

a main body, having a hole disposed at an action end of said main body;

a ratchet, having a polygonal groove disposed at the center of said ratchet and a latch hole and a latch groove interconnected with said polygonal groove, and said latch hole being disposed at an edge of said polygonal groove, and said latch groove being disposed at a corner of said polygonal groove, and the whole being received into the hole of said main body;

a latch ring, disposed around the external periphery of said ratchet and having an end bent into a latch end to be latched into the latch hole of said ratchet and the other end bent into a latch surface to be latched into said latch groove, and said latch end and said latch surface being slightly protruded from said polygonal groove, such that when said polygonal groove of said ratchet connects an object, two different latch structures are defined between said latch ring and said object.

2. The ratchet wrench of claim 1, wherein said main body comprises a containing groove disposed on a side of said hole, a handle section including a control groove disposed proximate to said containing groove, and a bead groove disposed along the radial direction from said control groove, such that said containing groove, said control groove, and said bead groove are interconnected.

3. The ratchet wrench of claim 1, wherein said main body includes a buckle groove disposed on said hole.

4. The ratchet wrench of claim 1, wherein said ratchet includes an engaging tooth disposed at the external periphery of said ratchet.

5. The ratchet wrench of claim 1, wherein said latch groove and said latch hole of ratchet are parallel with each other.

6. The ratchet wrench of claim 2, wherein said brake tooth is semicircular and has a latch tooth disposed on one side and a concave surface disposed on a rear side, and said brake tooth controls a control structure to move in said containing groove of said main body.

7. The ratchet wrench of claim 6, wherein control structure is a control component having a containing hole disposed at its front side for containing a press nut and an elastic component, and said press nut presses said concave surface of said brake tooth, such that said brake tooth and said ratchet are engaged with each other, and said control component is pivotally coupled with said control groove of said main body, and said control component forms a pressing surface at its upper end to be latched by a press plate, and said press plate is contained in said containing groove of said main body, and said control component forms a concave edge at its rear side for pressing a bead and an elastic member, and said bead and elastic member are contained in said bead groove of said main body, such that said bead is fixed when said control component is rotated in said control groove.

8. The ratchet wrench of claim 1, wherein said latch ring surrounds said ratchet in a range larger than 180 degrees.

9. The ratchet wrench of claim 1, wherein said turntable is installed onto said ratchet and said turntable has an external diameter larger than the internal diameter of said hole, and said turntable and said ratchet are coupled integrally.

10. The ratchet wrench of claim 3, wherein said chassis is latched onto said buckle groove of said main body by said buckle, and said chassis seals all components into said main body, and said latch ring is exposed from said chassis.

11. The ratchet wrench of claim 1, wherein said hole of said main body having a diameter slightly larger than a hole of said containing groove and including a containing section with the same diameter disposed at said ratchet at a position corresponding to said containing groove of said main body.

12. The ratchet wrench of claim 2, wherein said containing groove of said main body is sealed at the top and bottom of said containing groove.

13. The ratchet wrench of claim 1, wherein said latch ring has an external diameter larger than the internal diameter of said hole of said main body.

* * * * *